US009695676B2

(12) United States Patent
Kriesels et al.

(10) Patent No.: US 9,695,676 B2
(45) Date of Patent: Jul. 4, 2017

(54) SYSTEM AND METHOD FOR LINING A BOREHOLE

(71) Applicant: SHELL OIL COMPANY, Houston, TX (US)

(72) Inventors: Petrus Cornelis Kriesels, Rijswijk (NL); Fausto Ciotta, Rijswijk (NL)

(73) Assignee: SHELL OIL COMPANY, Houston, TX (US)

( * ) Notice: Subject to any disclaimer, the term of this patent is extended or adjusted under 35 U.S.C. 154(b) by 321 days.

(21) Appl. No.: 14/438,837

(22) PCT Filed: Oct. 28, 2013

(86) PCT No.: PCT/EP2013/072481
§ 371 (c)(1),
(2) Date: Apr. 27, 2015

(87) PCT Pub. No.: WO2014/067889
PCT Pub. Date: May 8, 2014

(65) Prior Publication Data

US 2015/0300134 A1 Oct. 22, 2015

(30) Foreign Application Priority Data

Oct. 29, 2012 (EP) ..... 12190413

(51) Int. Cl.
*E21B 43/10* (2006.01)

(52) U.S. Cl.
CPC ..... *E21B 43/105* (2013.01); *E21B 43/108* (2013.01)

(58) Field of Classification Search
CPC ..... E21B 43/105; E21B 43/108
See application file for complete search history.

(56) References Cited

U.S. PATENT DOCUMENTS 7,150,328 B2 12/2006 Marketz et al.
7,464,774 B2 12/2008 Savignat et al.
(Continued)

FOREIGN PATENT DOCUMENTS

CN 101910554 12/2010
EP 2041393 1/2001
(Continued)

OTHER PUBLICATIONS

PCT International Search Report, Application No. PCT/EP2013/072481 dated Dec. 10, 2013.

*Primary Examiner* — Brad Harcourt
*Assistant Examiner* — Steven MacDonald

(57) ABSTRACT

The invention provides a system and method for lining a borehole. The system comprises: an expandable tubular element extending into the borehole, wherein an end portion of a wall of the expandable tubular element is bent radially outward and in axially reverse direction to define an expanded tubular section extending around an unexpanded tubular section; a pipe extending through the expanded tubular section; a connecting device for connecting the pipe to the unexpanded tubular section, the connecting device allowing the pipe to rotate relative to the unexpanded tubular section around a longitudinal axis of the pipe; a rotating device for rotating the pipe relative to the unexpanded tubular section around said longitudinal axis; and an actuator for moving the pipe in axial direction into the expanded tubular section to extend the expanded tubular section and thereby to form a liner of the borehole.

17 Claims, 3 Drawing Sheets

(56) References Cited

U.S. PATENT DOCUMENTS

| | | | |
|---|---|---|---|
| 8,056,641 | B2 | 11/2011 | Kriesels et al. |
| 8,387,709 | B2 | 3/2013 | Kriesels |
| 8,430,177 | B2 | 4/2013 | Van Nieuwkoop |
| 8,479,843 | B2 | 7/2013 | Kriesels |
| 8,555,987 | B2 | 10/2013 | Kriesels et al. |
| 2012/0138314 | A1 | 6/2012 | Kriesels |

FOREIGN PATENT DOCUMENTS

| | | |
|---|---|---|
| EP | 2209966 | 7/2010 |
| EP | 2460972 | 6/2012 |
| GB | 2456699 | 7/2009 |
| GB | 2467242 | 7/2010 |
| GB | 2469399 | 11/2011 |
| GB | 2469396 | 1/2012 |
| GB | 2468416 | 2/2012 |
| GB | 2467866 | 3/2012 |
| GB | 2468230 | 4/2012 |
| GB | 2469213 | 1/2013 |
| WO | 2008006841 | 1/2008 |
| WO | 2009056514 | 5/2009 |
| WO | 2012059574 | 5/2012 |
| WO | 2012059578 | 5/2012 |
| WO | 2012095472 | 7/2012 |
| WO | 2013004610 | 1/2013 |

SYSTEM AND METHOD FOR LINING A BOREHOLE

CROSS-REFERENCE TO RELATED APPLICATIONS

The present application is a National Stage (§371) of International Application No. PCT/EP2013/0072481, filed Oct. 28, 2013, which claims priority from European Application No. 12190413.0, filed Oct. 29, 2012, the disclosures of each of which are hereby incorporated by reference in their entirety.

The present invention relates to a system and method for lining a borehole formed in an earth formation. The invention also relates to a method of using said system.

The technology of radially expanding tubular elements finds increasing application in the industry of oil and gas production from subterranean formations. Wellbores are generally provided with one or more casings or liners to provide stability to the wellbore wall, and/or to provide zonal isolation between different earth formation layers. The terms "casing" and "liner" refer to tubular elements for supporting and stabilising the wellbore wall. Typically, a casing extends from surface into the wellbore and a liner extends from a certain depth further into the wellbore. However, in the present context, the terms "casing" and "liner" are used interchangeably and without such intended distinction.

In conventional wellbore construction several casings are set at depth intervals, in a nested arrangement. Herein, each subsequent casing is lowered through the previous casing and therefore must have a smaller diameter than the previous casing. As a result, the cross-sectional area of the wellbore that is available for oil and gas production decreases with depth.

To alleviate this drawback, it is possible to radially expand one or more tubular elements at a desired depth in the wellbore, for example to form an expanded casing, expanded liner, or a clad against an existing casing or liner. Also, it has been proposed to radially expand each subsequent casing to substantially the same diameter as the previous casing to form a monodiameter wellbore. It is thus achieved that the available diameter of the wellbore remains substantially constant along (a section of) its depth as opposed to the conventional nested arrangement.

WO-2008/006841 discloses a wellbore system for radially expanding a tubular element in a wellbore. The wall of the tubular element is induced to bend radially outward and in axially reverse direction so as to form an expanded section extending around an unexpanded section of the tubular element. The length of the expanded tubular section is increased by moving, for instance by forcing or pushing, the unexpanded section into the expanded section. Herein the expanded section retains the expanded tubular shape. At its top end, the unexpanded section can, for instance, be extended by adding pipe sections or by unreeling, folding and welding a sheet of material into a tubular shape.

WO-2009/056514 discloses a method of radially expanding a tubular element by eversion. The tubular element includes a first layer and a second layer extending around the first layer, said layers being separable from each other.

EP-2460972-A1 discloses a method and system for radially expanding a tubular element by eversion. Heating means are provided to heat the bending zone during the eversion process.

The present invention aims to improve the above referenced prior art system.

The invention provides a system for lining a borehole formed in an earth formation, the system comprising:

- an expandable tubular element extending into the borehole, wherein an end portion of a wall of the expandable tubular element is bent radially outward and in axially reverse direction to define an expanded tubular section extending around an unexpanded tubular section;
- a pipe extending through the expanded tubular section;
- a connecting device for connecting the pipe to the unexpanded tubular section in a manner that the pipe is allowed to rotate relative to the unexpanded tubular section around a longitudinal axis of the pipe;
- a rotating device for rotating the pipe relative to the unexpanded tubular section around said longitudinal axis; and
- an actuator for moving the pipe deeper into the expanded tubular section so as to extend the expanded tubular section and thereby to form a liner of the borehole.

By simultaneously rotating the pipe around its longitudinal axis during downward movement of the pipe into the borehole, it is achieved that axial friction forces between the pipe and the expanded tubular section are reduced. Thereby, the force required to move the pipe downward is reduced. Also there is a reduced risk of the pipe becoming stuck in the expanded tubular section.

Suitably the pipe extends at a first radial distance from the expanded tubular section and the unexpanded tubular section extends at a second radial distance from the expanded tubular section, and wherein the first radial distance is smaller than the second radial distance. In this manner the radial clearance between the pipe and the expanded tubular section is reduced. For example, the pipe suitably can have a larger outer diameter than the unexpanded tubular section. In this manner the expanded tubular section can provide support to the pipe so that the risk of buckling or collapse of the pipe is reduced. The pipe does not have to be everted and is therefore not subjected to geometrical and/or material restrictions that may apply to the expanded tubular section. Therefore the pipe can be made more robust than the expanded tubular section, for example by means of a relatively large outer diameter close to the inner diameter of the expanded tubular section, and/or by a relatively large wall thickness.

Preferably, the pipe has a larger resistance to buckling than the unexpanded tubular section. This is for instance achieved if a pipe wall thickness exceeds the wall thickness of the unexpanded tubular section.

Suitably the connecting device comprises an upper connecting member provided to the pipe and a lower connecting member provided to the unexpanded tubular section, wherein one of said connecting members is provided with an annular recess and the other of said connecting members is provided with an annular protrusion removably positioned in the annular recess so as to align the pipe with the unexpanded tubular section and to allow the pipe to be lifted from the unexpanded tubular section.

To prevent fluid migration between the connecting members from the interior of the pipe to the exterior of the tube and vice versa, suitably sealing means is arranged to seal the connecting members to each other. For example, the sealing means includes at least one seal ring arranged in the annular recess.

In a suitable embodiment, the annular recess comprises an annular groove formed in an end surface of said one of the connecting members and wherein said at least one seal ring includes an outer seal ring arranged at a radially outer surface of the annular groove and an inner seal ring arranged at a radially inner surface of the annular groove.

The annular recess can be provided at the lower connecting member and the annular protrusion can be provided at the upper connecting member.

Advantageously one of said connecting members is a rotatable connecting member comprising an upper part, a lower part and bearing means allowing the upper part to rotate relative to the lower part around said longitudinal axis.

The bearing means may comprise a radial bearing arranged to transfer radial loads between the upper part and the lower part, and a thrust bearing arranged to transfer axial loads between the upper part and the lower part.

The system of the invention is suitably used in conjunction with a drill string extending through the unexpanded tubular section for further drilling of the borehole. In such application the actuator is preferably adapted to move the pipe axially downward at a speed substantially twice the speed of lowering the drill string into the borehole during further drilling of the borehole with the drill string.

In an attractive application, the borehole is a wellbore for the production of hydrocarbon fluid. Also, the pipe and/or the expanded tubular section can be a service pipe for transporting fluid such as water or hydrocarbon fluid between a first location and a second location. For example, if said locations are arranged at opposite sides of a body of water, such as a river, a canal or a sea, the borehole suitably passes through the earth formation below the body of water.

According to another aspect, the invention provides a method of lining a borehole formed in an earth formation using the system as described above, the method comprising the steps of:

- inducing the actuator to move the pipe axially into the expanded tubular section so as to further expand the expandable tubular element; and
- inducing the rotating device to rotate the pipe relative to the unexpanded tubular section around said longitudinal axis of the pipe.

Herein, moving the pipe into the expanded tubular section preferably means pushing the pipe into the expanded tubular section.

Suitably, inducing of the actuator to move the pipe axially deeper into the expanded tubular section is stopped when the connecting device arrives at or near said end portion of the wall of the expandable tubular element.

By moving the unexpanded tubular section downward relative to the expanded tubular section, the tubular element is effectively turned inside out. The tubular element is progressively expanded without an expander that is pushed, pulled or pumped through the tubular element. The expanded tubular section can form a casing or liner in the borehole. The expanded tubular liner may have a collapse resistance which is adequate to stabilize or support the borehole wall.

It is preferred that the wall of the tubular element includes a material that is plastically deformed during expansion. The expanded tubular section will retain an expanded shape due to the plastic deformation, i.e. permanent deformation, of the wall of the expandable tubular element. There is no need to apply an external force or pressure to maintain the expanded tubular section in its expanded form. If, for example, the expanded tubular section engages the borehole wall, no additional radial force or pressure needs to be exerted to keep the expanded tubular section against the borehole wall.

The wall of the tubular element may comprise a metal such as steel or any other ductile metal capable of being plastically deformed by eversion of the tubular element. The expanded tubular section preferably has adequate collapse resistance to support or stabilize the borehole wall. Depending on the respective formation, the collapse resistance of the expanded tubular section may exceed, for example, 100 bar, 150 bar, or about 1500 bar or more.

In order to induce said downward movement of the unexpanded tubular section, the unexpanded tubular section is subjected to an axial compressive force. The axial compressive force preferably results at least partly from the weight of the pipe and the unexpanded tubular section. The actuator may supplement the combined weight of the unexpanded tubular section and pipe by applying an additional external force to the pipe to induce said movement. The additional force applied by the actuator may be upward or downward. For instance, as the length and hence the combined weight of the unexpanded tubular section and pipe increases, an upward force may need to be applied to the pipe to maintain the total downward force applied to the unexpanded tubular section within a predetermined range. Maintaining the total force within said range will prevent uncontrolled bending or buckling in the bending zone.

The unexpanded tubular section is axially shortened at its lower end due to progressive eversion. It is therefore preferred that the pipe is axially extended at its upper end in correspondence with said axial shortening. By extending the pipe at its upper end to compensate for shortening of the unexpanded tubular section, the process of eversion of the tubular element can be continued until a desired length of the expanded tubular section is reached. The pipe can be extended at its upper end, for example, by connecting an additional pipe section to the upper end in any suitable manner such as by welding.

The invention will be described hereinafter in more detail and by way of example with reference to the accompanying drawings in which.

In the drawings and the description, like reference numerals relate to like components.

Figure 1:
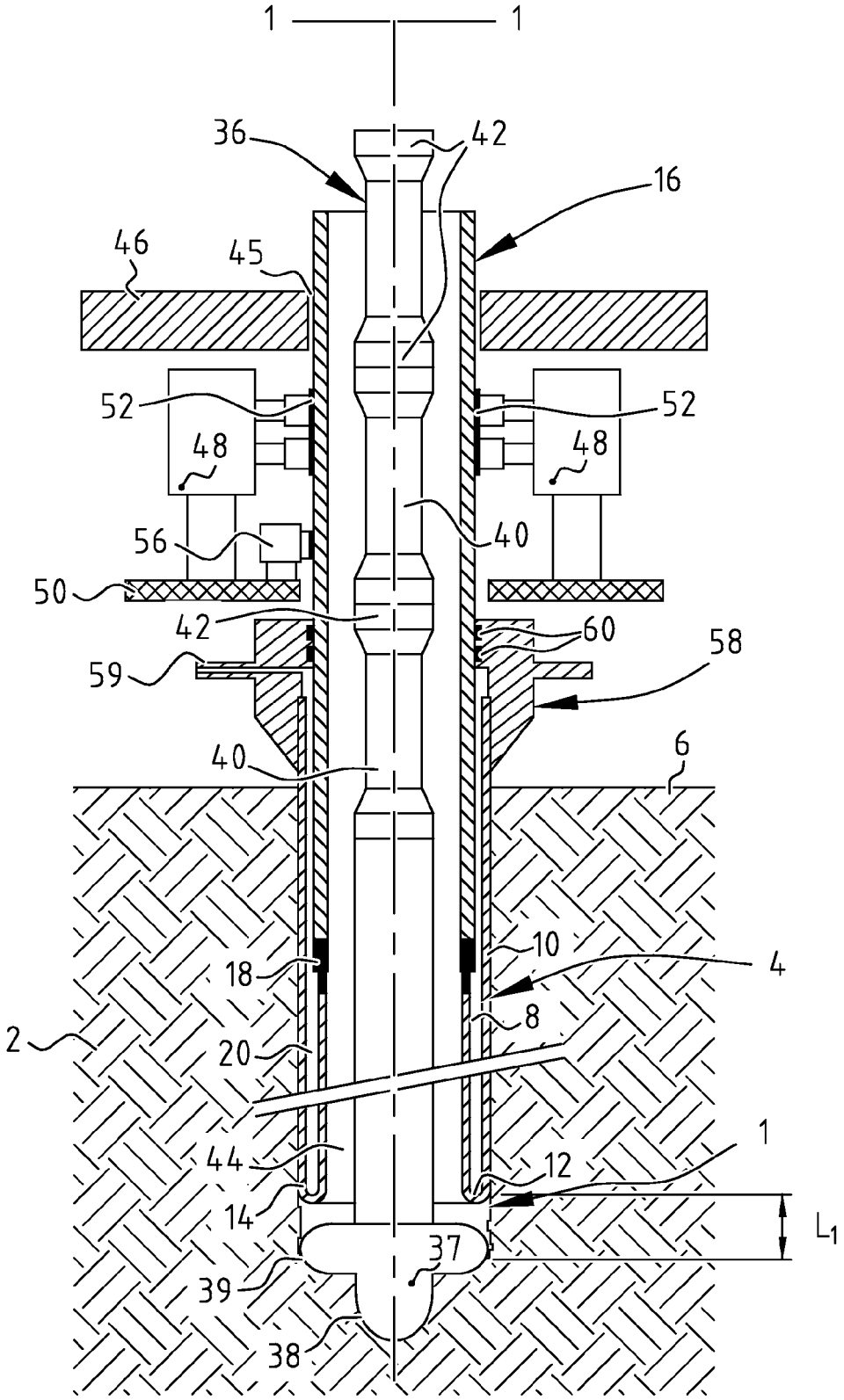
FIG. 1 shows an embodiment of a system for lining a wellbore in accordance with the invention.
Figure 2:
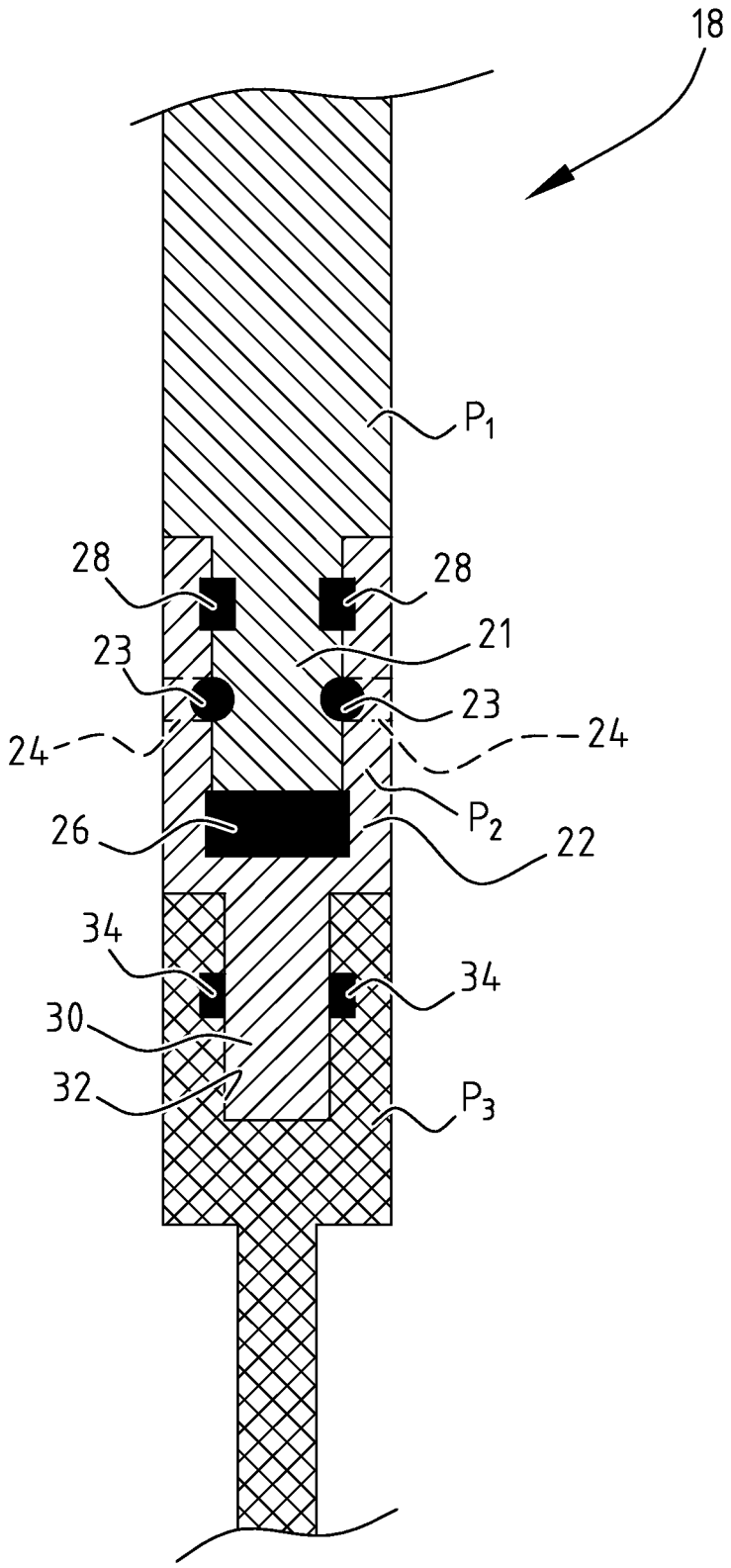
FIG. 2 shows a connecting device used in the embodiment of FIG. 1 in more detail.

FIGS. 1 and 2 show a system for lining a borehole 1 formed in an earth formation 2. The borehole 1 is provided with an expandable tubular element 4. The tubular element 4 is for instance made of steel. Reference sign 6 indicates the earth surface.

The tubular element 4 includes an unexpanded tubular section 8 and a radially expanded tubular section 10. The outer diameter of the expanded section 10 may be substantially equal to the diameter of the borehole. Hereinafter the expandable tubular element may also be referred to as "liner", the unexpanded tubular section may be referred to as "unexpanded liner section", and the radially expanded tubular section may be referred to as "expanded liner section". The unexpanded liner section 8 extends substantially concentrically within the expanded liner section 10.

The unexpanded liner section 8 has an upper end located at a position in the wellbore 1 commensurate with the length and depth of the borehole section that is to be lined by eversion of the expandable tubular element 4, as will be described hereinafter.

The lower end of the unexpanded liner section 8 may be located a relatively short distance above the downhole end of the borehole 1 during drilling thereof. At said lower end, the wall of the unexpanded liner section 8 bends radially outward and in axially reverse (in FIG. 1 upward) direction to form a curved lower section 12 defining a bending zone 14 of the tubular element 4. The curved lower section 12 is U-shaped in cross-section and interconnects the unexpanded liner section 8 and the expanded liner section 10.

A pipe 16 extends from surface down into the expanded liner section 10. The pipe 16 is for instance made of steel or a similar material having a suitable strength. A downhole end of the pipe 16 is connected to an upper end of the unexpanded liner section 8 via a connecting device 18. The pipe 16 may have a larger outer diameter than the unexpanded tubular section 8, but leaves sufficient clearance between the pipe 16 and the expanded liner section 10 to allow unobstructed movement of the pipe 16 through the expanded liner section 10. Thus, an annular space 20 is formed extending between the expanded liner section on one hand and the unexpanded liner section and the pipe on the other hand. The annular space 20 is closed at its lower end by the curved lower section 12 of the expandable tubular element 4. The annulus 20 may therefore be referred to as a blind annulus. In an embodiment, the pipe 16 has a larger wall-thickness, and therefore a higher collapse resistance and buckling resistance, than the unexpanded liner section 8.

As shown in more detail in FIG. 2, the annular connecting device 18 may comprise a first part P1, a second part P2 and a third part P3. The first part P1 is fixedly connected to the lower end of the pipe 16, for instance by threading or welding. Alternatively, the first part P1 can be integrally formed with the pipe 16.

The first part P1 has a portion of reduced wall-thickness 21 that fits into a U-shaped portion 22 of the second part P2. One or more radial bearings 23, for instance ball bearings, may be provided between the portion of reduced wall thickness 21 and the U-shaped portion 22 to allow the second part P2 to rotate relative to the first part P1 around a central longitudinal axis of the annular connecting device. The bearing balls ride on respective bearing races (not shown) provided in the portion of reduced wall-thickness 21 and in the U-shaped portion 22. The bearing balls can be inserted into the races, or be removed therefrom, via closable openings 24 provided in the U-shaped portion 22. The one or more radial bearings 23 allow radial loads to be transmitted between the first part P1 and the second part P2, and substantially prevent axial movement of the second part P2 relative to the first part P1 except perhaps for some minimal axial movement due to normal tolerances.

An annular thrust bearing 26 may be arranged between the portion of reduced wall thickness 21 and the U-shaped portion 22 to allow axial loads to be transmitted between the first part P1 and the second part P2. In a suitable embodiment, the thrust bearing 26 can be a Teflon ring. To prevent undesired migration of wellbore fluid between the first part P1 and the second part P2, the first part P1 is sealed relative to the second part P2 by one or more seal rings 28. Furthermore, the second part P2 has at the lower end thereof an annular protrusion 30, which will be referred to in more detail hereinafter.

The third part P3 may be fixedly connected to the upper end of the unexpanded liner section 10, for instance by threading or welding. Alternatively, the lower connecting member P3 can be integrally formed with the unexpanded liner section 10.

The third part P3 may at the upper end thereof be provided with an annular recess 32 into which the annular protrusion 30 of the second part P2 snugly fits in a manner allowing the annular protrusion 30 to be axially moved into, and out of, the annular recess 32. When the annular protrusion 30 is positioned in the annular recess 32, the pipe 16 is substantially aligned with the unexpanded liner section 8.

One or more seal rings 34 may be provided between the annular protrusion 30 and the wall of the annular recess 32 to prevent undesired migration of wellbore fluid between the blind annulus 20 and the inner space of the pipe 16.

Although the wellbore shown in FIG. 1 extends vertically into the earth formation 2, the present invention is equally suitable for any other wellbore. For instance, at least a part of the borehole 1 may extend inclined or horizontally. Therefore, in this description, references to "upper" and "lower" in relation to the borehole are intended to refer to borehole positions measured along-hole.

A drill string 36 may extend from surface through the pipe 16 and the unexpanded liner section 8 to the downhole end of the borehole 1. The lower end of the drill string 36 is provided with a drill bit 37 comprising a pilot bit 38 of outer diameter slightly smaller than the inner diameter of the unexpanded liner section 8 and also smaller than the inner diameter of the pipe 16, and a reamer section 39 having an outer diameter adapted to drill the wellbore 1 to its nominal diameter. The reamer section 39 may be radially retractable to a smaller outer diameter, allowing it to pass through the unexpanded liner section 8 and through the pipe 16 so that the drill bit 37 can be lowered into the wellbore or retrieved to surface. The drill string 36 may comprise multiple drill pipe sections 40 mutually interconnected by threaded connections 42. An annular space 44 is formed between the drill string 36 on one hand and the unexpanded liner section 8 and the pipe 16 on the other hand, said annular space 44 being referred to hereinafter as the drilling annulus 44.

The connections 42 are not shown in detail, but comprise for instance threaded pin and box type connections. The connections 42 may comprise joints fabricated with male threads on each end, wherein short-length coupling members (not shown) with female threads are used to join the individual joints of drill string together, or joints with male threads on one end and female threads on the other. The threaded connections may comprise connections which are standardized by the American Petroleum Institute (API). The drill string 36 and the pipe 16 extend through an opening 45 of a rig floor 46 which is part of a drilling rig (not shown).

A pipe pusher 48 may be provided for moving the pipe 16 into the borehole, for instance in downward direction. The pipe pusher 48 is for instance arranged below the rig floor and is supported by a base frame 50 that is connected to the drilling rig or directly to surface 6. The pipe pusher may comprise one or more conveyor belts 52, whereby each conveyor belt engages the outer surface of the pipe 16 and is driven by a respective motor (not shown). Each conveyer belt 52 is adapted to exert a downward force to the pipe 16. The pipe pusher pushes the pipe into the borehole. Other embodiments of the pipe pusher 48 capable of exerting downward or upward force to the pipe are conceivable.

A rotating device 56 may be provided for rotating the pipe 16 around its central longitudinal axis. In the present example the rotating device 56 is arranged at the base frame below the rig floor. The rotating device 56 can be arranged at any other suitable location.

A sealing device 58 can be connected to the upper end of the expanded liner section 10 to seal the pipe 16 relative to the expanded liner section 10. Herein, the sealing device 58 enables the pipe 16 to slide in axial direction relative to the sealing device 58. The sealing device comprises a conduit 59 connected to a pump (not shown) for pumping fluid into or out of the blind annulus 20. The sealing device includes one, two or more annular seals 60 whereby each annular seal engages the outside of the pipe 16 so as to prevent undesired outflow of fluid from the blind annulus. Preferably the sealing device 58 comprises at least two seals 60 to provide improved safety and reliability in case one of the seals fails.

The sealing device 58 can be regarded as a blind annulus blow out preventer (BABOP). Therefore, the annular seals 60, the connection of the sealing device 58 to the upper end of the expanded liner section 10, and one or more valves (not shown) for closing conduit 59 are all designed to withstand fluid pressures that may arise in a well control situation. Depending on specifics of the formation, the sealing device 58 is for instance designed to withstand fluid pressures that may be expected in case of a blowout, for instance in the range of 200 bar to 1600 bar or more, for instance about 400 bar to 800 bar or more. Such pressures may arise in the blind annulus 20 in case of a failure, for instance rupturing of the expandable tubular element 4, in combination with a well control situation.

The expanded liner section 10 is axially fixed relative to the wellbore by any suitable fixation means. For instance, the upper end of the expanded liner section may be connected to a ring or flange (not shown) by welding and/or screwing. Said ring can be attached to or incorporated in any suitable structure at surface, such as the sealing device 58. The inner diameter of said ring may be larger than the outer diameter of the expanded liner section. Optionally, the expanded liner section 10 may be fixed to the wellbore wall, for instance by virtue of frictional forces between the expanded liner section 10 and the wellbore wall as a result of the expansion process. Alternatively, or additionally, the expanded liner section 10 can be anchored, for instance to the wellbore wall, by any suitable anchoring means.

Figure 3:
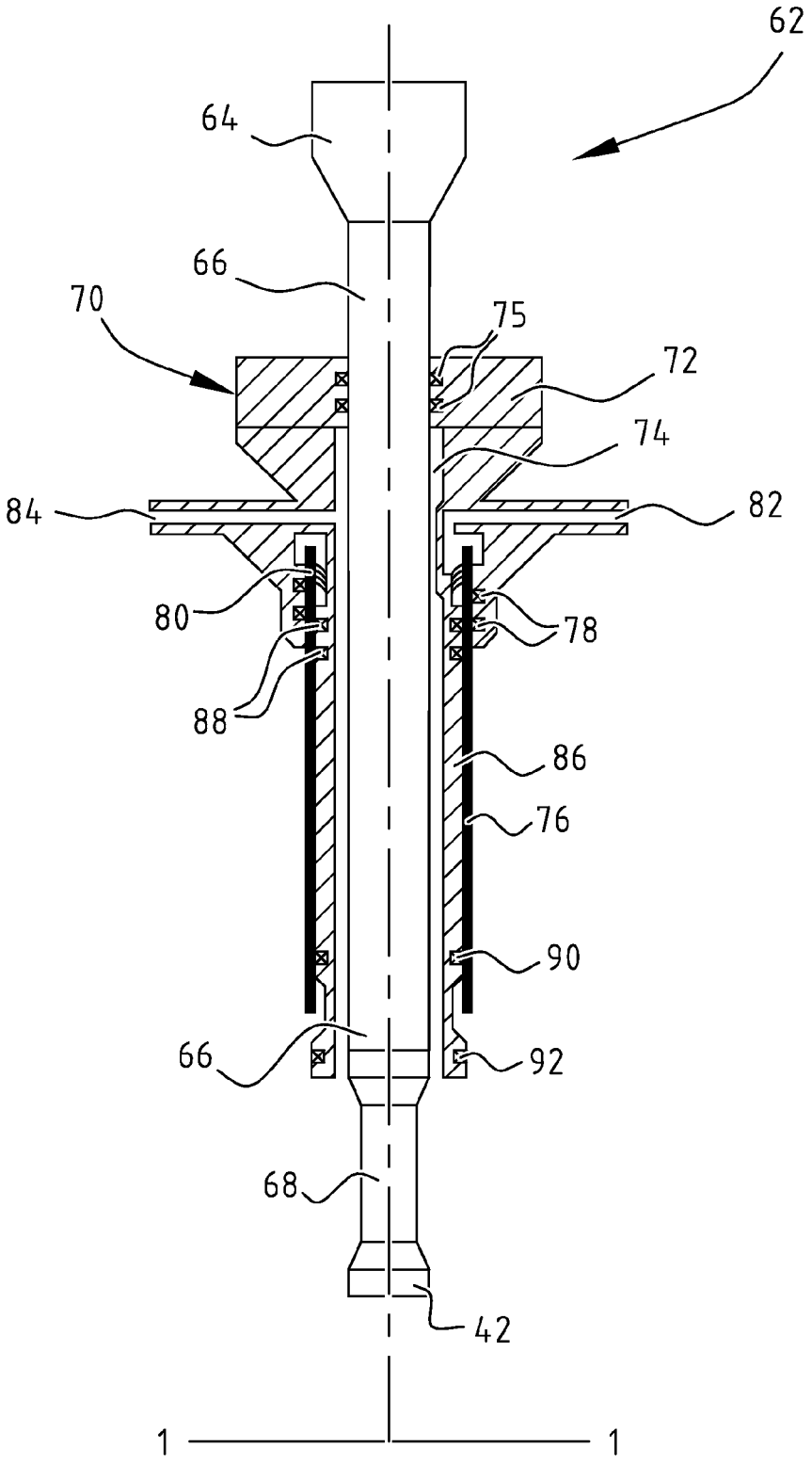
FIG. 3 shows an optional top drive system for use in combination with the embodiment of FIGS. 1 and 2.

FIG. 3 shows a top drive system 62 for optional use in combination with the system of FIG. 1. The top drive system is adapted to be connected to the system of FIG. 1 at the common interface indicated by line 1-1 (FIGS. 1 and 2), and comprises a motor 64 and an upper connection part 66 driven by the motor. In the present example, the upper connection part forms a flush pipe 66 having a smooth outer surface and being connected at its lower end to an additional drill string section 68 by means of a threaded connection 42 as described above. Typically, the additional drill string section 68 is substantially similar to the drill string sections 40 shown in FIG. 1. At the interface indicated by line 1-1, the additional drill string section 68 can be connected to the upper end of the drill string 36 shown in FIG. 1.

The top drive system 62 may further comprise a drilling annulus sealing device 70 including a housing 72 that encloses the flush pipe 66, with an annular space 74 there between. The annular space 74 is in fluid communication with the drilling annulus 44. At the top end, near the top drive motor 64, the housing 72 comprises one, two or more seals 75 which engage the outside of the flush pipe 66. The seals 75 enable the housing to slide along the flush pipe 66. Furthermore, the top drive system comprises an additional pipe section 76 of substantially the same outer diameter and wall-thickness as the pipe 16. The housing 72 may comprise one, two or more seals 78 which engage the outer surface of the additional pipe section 76. In addition to the seals 78, the housing may comprise grippers 80 that engage the outside and/or the inside of the additional pipe section 76. An activation conduit 82 is connected to the housing for activating or releasing the seals 78 and/or the grippers 80. A fluid conduit 84 is provided to the housing for supply or drainage of (drilling) fluid to or from the drilling annulus 44 via the annular space 74.

The sealing device 70 comprises an extending part or stinger 86 that extends into the inside of the additional pipe section 76. The stinger may comprise seals 88 and/or grippers to engage the upper end of the pipe section 76. The stinger may also comprise seals 90 to engage a lower end of the pipe section 76, and seals 92 to engage the inside of the upper end of the pipe 16. A backing gas tool (not shown) may be integrated in the stinger between the seals 90, 92 to cover the inner interface between the additional pipe section 76 and the pipe 16. The stinger 86 is at least slightly longer than the pipe section 76 so that the stinger may extend into the pipe 16 to enable the stinger to function as an alignment tool for aligning the pipe section 76 and the pipe 16. In practice, the length of the pipe section 76 may be in the range of about 5-20 meters, for instance 10 meters. The stinger will for instance be about 2% to 10% longer, for instance 5% longer than the pipe section 76.

The sealing device 70 may be referred to as drilling annulus blow out preventer (DABOP). The seals 75, 78, 88, 90, 92, the grippers 80, and one or more valves (not shown) for closing conduits 82, 84 are all designed to at least withstand fluid pressures that may arise in a well control situation. Depending on specifics of the formation and the expected maximum pore pressures, the DABOP 70 is for instance designed to withstand pressures in the range of about 200 bar to 800 bar or more, for instance about 400 bar.

The DABOP may comprise any number of seals, for example one seal 75 and one seal 78, or a plurality of seals. In a practical embodiment, two seals 75 that engage the flush pipe 66 and two seals 78 that engage the pipe section 76 will provide a balance between fail-safety and reliability on one hand and costs on the other hand. For instance, the double barrier provided by the inner seals 88 engaging the inside of the pipe section 76, and the outer seals 78 engaging the outside of the pipe section 76, improves the reliability and leak-tightness of the sealing device 70.

In a practical embodiment, the diameter and/or wall thickness of the expandable tubular element 4 is selected such that the expanded liner section 10 is pressed against the wellbore wall during the eversion process. The expanded liner section 10 may thus seal against the wellbore wall and/or stabilize the wellbore wall.

The wall thickness of the expandable tubular element 4 may be equal to or larger than about 2 mm (0.08 inch), for example larger than 2.5 mm. The wall thickness is for instance about 3 to 30 mm or about 3.2 to 10 mm. The outer diameter of the unexpanded liner section may be larger than 50 mm (2 inch), for instance in the range of about 50 to 400 mm (16 inch). The expanded liner section may have any outer diameter suitable for, or commonly used in, hydrocarbon production. The wall of the expandable tubular element 4 may comprise a relatively strong material, such as a metal, preferably steel. Thus, the expandable tubular element 4 can be designed to have adequate collapse strength to support the wellbore wall and/or to withstand internal or external pressures encountered when drilling for hydrocarbon reservoirs.

The length and hence the weight of the assembly of pipe and unexpanded liner section 8 gradually increases during extension of the wellbore. Hence, the downward force exerted by the pipe pusher 48 can be gradually decreased in correspondence with the increasing weight. As said weight increases, the downward force eventually may need to be replaced by an upward force to maintain the total force within a predetermined range and to prevent buckling of the unexpanded liner section 8.

Normal operation of the embodiment of FIGS. 1-3 with the optional top drive system included will be described hereinafter.

The drill string 36 is operated to rotate the drill bit 37 so as to further deepen the wellbore, whereby the drill string is gradually lowered into the wellbore. Simultaneously, the pipe pusher 48 is operated to push the pipe 16 deeper into the wellbore at a speed substantially twice the speed of downward movement of the drill string 36. The pipe 16 thereby forces the unexpanded liner section 8 in downward direction, whereby the necessary axial load is transmitted from the pipe 16 to the unexpanded liner section 8 via the thrust bearing 26 of the connecting device 18. Since the expanded liner section 10 remains stationary in the wellbore, the unexpanded liner section 8 becomes thereby gradually everted to further form the expanded liner section 10. During the eversion process, the bending zone 14 moves in downward direction at substantially the same speed at which the drill string 36 is lowered into the wellbore. In this manner the bending zone 14 remains at a relatively short distance above the drill bit 37. Herein, said short distance indicates the so-called open hole section L1 (see FIG. 1), i.e. the unlined section, of the wellbore 1. The method of the present invention enables an open hole section of length L1 less than, for instance, 100 meters or even less than 50 meters at all times while drilling the wellbore.

In order to reduce axial friction between the pipe 16 and the expanded tubular section 10 on one hand, and between the pipe 16 and the drill string 36 on the other hand, the rotating device 56 may induced the pipe 16 to rotate around its central longitudinal axis. The rotation may be simultaneously with downward movement of the pipe 16 into the wellbore 1. The first part P1 of the connecting device 18, which is fixedly connected to the pipe 16, is allowed to rotate relative to the second part P2 and third part P3 of the connecting device by virtue of the radial bearings 23.

In case it is desired to temporarily remove the pipe 16 from the wellbore during the drilling operation, for example for maintenance or repair of the connecting device 18, the pipe 16 is moved upwardly. Herein, the annular protrusion 30 of the second part P2 of the connecting device is lifted out of the annular recess 32 of the third part P3 of the connecting device. The pipe 16 can be reinstalled by lowering into the wellbore whereby the annular protrusion 30 becomes inserted into the annular recess 32.

The unexpanded liner section 8 may be supported by the drill string 36, for example by means of a bearing device (not shown) connected to the drill string, which supports the curved lower section 12 of the liner 4. In such application, an upward force is suitably transmitted from the drill string 36 to the curved lower section 12 via the bearing device. Furthermore, at least part of the weight of the unexpanded liner section 8 and the pipe then can be transferred to the drill string and utilised to provide a thrust force to the drill bit 37.

Drilling fluid containing drill cuttings is discharged from the drilling annulus 44 via fluid conduit 84. Alternatively, drilling fluid may be circulated in reverse circulation mode wherein the drilling fluid is pumped into the wellbore via the conduit 84 and discharged from the wellbore via the drill string 36.

When it is required to retrieve the drill string 36 to surface, for example when the drill bit 37 is to be replaced or when drilling of the wellbore 1 has been completed, the reamer section 39 can be collapsed to its radially retracted mode, wherein the radial diameter is smaller than the internal diameter of the unexpanded liner section 8 and the pipe 16. Subsequently, the drill string 36 can be retrieved through the unexpanded liner section 8 and the pipe 16 to surface.

With the wellbore system of the invention, it is achieved that the wellbore is progressively lined with the everted liner directly above the drill bit, during the drilling process. As a result, there is only a relatively short open-hole section L1 of the wellbore during the drilling process at all times. An important advantage of a short open hole section is the reduced risk of influx of formation fluid into the wellbore during drilling. This eliminates or minimizes undesired increases of fluid pressure in the wellbore and simplifies well control. The advantages of such short open-hole section will be most pronounced during drilling into a hydrocarbon fluid containing layer of the earth formation. In view thereof, for many applications it will be sufficient if the process of liner eversion during drilling is applied only during drilling into the hydrocarbon fluid reservoir, while other sections of the wellbore are lined or cased in conventional manner. Alternatively, the process of liner eversion during drilling may be commenced at surface or at a selected downhole location, depending on circumstances.

In view of the short open-hole section during drilling, there is a significantly reduced risk that the wellbore fluid pressure gradient exceeds the fracture gradient of the rock formation, or that the wellbore fluid pressure gradient drops below the pore pressure gradient of the rock formation. Therefore, considerably longer intervals can be drilled at a single nominal diameter than in a conventional drilling practice wherein casings of stepwise decreasing diameter must be set at selected intervals. Also, if the wellbore is drilled through a shale layer, such short open-hole section eliminates possible problems due to a heaving tendency of the shale.

Furthermore it is achieved that there is a significantly reduced risk of buckling or collapse of the pipe by virtue of its relatively large wall thickness.

After the wellbore has been drilled to the desired depth and the drill string has been removed from the wellbore, the pipe can be left in the wellbore or it can be retrieved to surface by lifting the annular protrusion of the second part P2 of the connecting device out of the annular recess of the third part P3 of the connecting device.

In case the pipe is left in the wellbore, there are several options for completing the wellbore. These are, for example, as outlined below.

A) A fluid, for example brine, is pumped into the blind annulus 44 so as to pressurise the blind annulus and increase the collapse resistance of the expanded liner section 10. Optionally one or more holes are provided in the U-shaped lower section 12 to allow the pumped fluid to be circulated.

B) A heavy fluid is pumped into the blind annulus 44 so as to support the expanded liner section 10 and increase its collapse resistance.

C) Cement is pumped into the blind annulus 44 in order to create a solid body between the pipe and the expanded liner section 10. The cement may expand upon hardening.

D) The pipe is radially expanded (i.e. clad) against the expanded liner section, for example by pumping, pushing or pulling an expander through the pipe.

In the above examples, expansion of the liner is started at surface or at a downhole location. In case of an offshore wellbore wherein an offshore platform is positioned above the wellbore, it may be advantageous to start the expansion process at the offshore platform, at or above the water surface. Herein, the bending zone moves from the offshore platform to the seabed and subsequently into the wellbore.

Thus, the resulting expanded tubular element not only forms a liner in the wellbore, but also a riser extending from the offshore platform to the seabed. The need for a separate riser is thereby obviated.

Furthermore, conduits such as electric wires or optical fibres for communication with downhole equipment can be extended in the annulus between the expanded and unexpanded sections. Such conduits can be attached to the outer surface of the tubular element before expansion thereof. Also, the expanded and unexpanded liner sections can be used as electricity conductors to transfer data and/or power downhole.

A friction reducing layer, such as a Teflon layer, may be applied between the pipe and the unexpanded liner section on one hand and the expanded liner section on the other hand, to reduce friction forces during the eversion process. For example, a friction reducing coating can be applied to the outer surface of the unexpanded liner section 8 and the pipe. Also, the friction reducing layer reduces the width of the blind annulus, and thereby minimizes or eliminates a possible tendency of the unexpanded liner section to buckle. Instead of, or in addition to, the friction reducing layer, centralizing pads and/or rollers can be applied in the blind annulus between the unexpanded and expanded sections to reduce the friction and the annular clearance.

Instead of expanding the expanded liner section against the wellbore wall (as described), the expanded liner section can be expanded against the inner surface of another tubular element, e.g. casing or a liner, already present in the wellbore.

Although the embodiments of the invention have been described including a top drive, the present invention is likewise suitable for use with alternative drilling systems. The latter may include for instance a downhole motor instead of a top drive. Said downhole motor is a drilling tool comprised in the drill string directly above the bit. Activated by pressurized drilling fluid, it causes the bit to turn while the drill string remains fixed. Examples of the downhole motor include a positive-displacement motor and a downhole turbine motor.

The present invention is likewise suitable for directional drilling, i.e. drilling wherein the drilling direction can be adjusted. For instance, a downhole motor may be used as a deflection tool in directional drilling, where it is made up between the bit and a bent sub, or the housing of the motor itself may be bent.

The present invention is not limited to the above-described embodiments thereof, wherein various modifications are conceivable within the scope of the appended claims. For instance, features of respective embodiments may be combined.

The invention claimed is:

1. A system for lining a borehole, the system comprising:

an expandable tubular element extending into the borehole, wherein an end portion of a wall of the expandable tubular element is bent radially outward and in axially reverse direction to define an expanded tubular section extending around an unexpanded tubular section;

a pipe extending through the expanded tubular section;

a connecting device for connecting the pipe to the unexpanded tubular section, the connecting device allowing the pipe to rotate relative to the unexpanded tubular section around a longitudinal axis of the pipe;

a rotating device for rotating the pipe relative to the unexpanded tubular section around said longitudinal axis; and an actuator for moving the pipe in axial direction into the expanded tubular section to extend the expanded tubular section and thereby to form a liner of the borehole.

2. The system of claim 1, wherein the pipe extends at a first radial distance from the expanded tubular section and the unexpanded tubular section extends at a second radial distance from the expanded tubular section, and wherein the first radial distance is smaller than the second radial distance.

3. The system of claim 2, wherein the pipe has a larger outer diameter than the unexpanded tubular section.

4. The system of claim 1, wherein the pipe has a larger resistance to buckling than the unexpanded tubular section.

5. The system of claim 4, wherein the pipe has a larger wall thickness than the unexpanded tubular section.

6. The system of claim 1, wherein the connecting device comprises:

an upper connecting member provided to the pipe;

a lower connecting member provided to the unexpanded tubular section, wherein one of said connecting members is provided with an annular recess and the other of said connecting members is provided with an annular protrusion removably positioned in the annular recess to align the pipe with the unexpanded tubular section and to allow the pipe to be lifted from the unexpanded tubular section.

7. The system of claim 6, further comprising sealing means arranged to seal the upper connecting member with respect to the lower connecting member to prevent fluid migration from the interior of the pipe to the exterior of the pipe and vice versa.

8. The system of claim 7, wherein the sealing means include at least one seal ring arranged in the annular recess.

9. The system of claim 8, wherein the annular recess comprises an annular groove, and wherein said at least one seal ring includes an outer seal ring arranged at a radially outer surface of the annular groove and an inner seal ring arranged at a radially inner surface of the annular groove.

10. The system of claim 6, wherein the lower connecting member is provided with the annular recess, and wherein the upper connecting member is provided with the annular protrusion.

11. The system of claim 6, wherein one of the lower connecting member and the upper connecting member is a rotatable connecting member comprising:

a first part;

a second part; and bearing means allowing the first part to rotate relative to the second part around said longitudinal axis.

12. The system of claim 11, wherein the bearing means comprise:

a radial bearing to transfer radial loads between the first part and the second part, and a thrust bearing to transfer axial loads between the first part and the second part.

13. The system of claim 11, wherein the rotatable connecting member is the upper connecting member.

14. The system of claim 1, wherein the actuator is adapted to move the pipe axially downward at a speed substantially twice the speed of lowering a drill string into the borehole during further drilling of the borehole with the drill string.

15. The system of claim 1, wherein one of the pipe and the expanded tubular section is a service pipe for transporting fluid between a first location and a second location.

16. The system of claim 15, wherein the first location and the second location are arranged at opposite sides of a body of water, and wherein the borehole passes through the earth formation below the body of water.

17. A method of lining a borehole, the method comprising the steps of:

providing an expandable tubular element extending into the borehole, wherein an end portion of a wall of the expandable tubular element is bent radially outward and in axially reverse direction to define an expanded tubular section extending around an unexpanded tubular section;

providing a pipe extending through the expanded tubular section;

connecting the pipe to the unexpanded tubular section using a connecting device, the connecting device allowing the pipe to rotate relative to the unexpanded tubular section around a longitudinal axis of the pipe;

rotating the pipe relative to the unexpanded tubular section around said longitudinal axis; and moving the pipe in axial direction into the expanded tubular section to extend the expanded tubular section and thereby to form a liner of the borehole.

* * * * *